US008070264B2

(12) United States Patent
Cornell et al.

(10) Patent No.: US 8,070,264 B2
(45) **Date of Patent: *Dec. 6, 2011**

(54) MICRO-FLUID EJECTION HEADS WITH MULTIPLE GLASS LAYERS

(75) Inventors: Robert Wilson Cornell, Lexington, KY (US); Michael John Dixon, Richmond, KY (US); Curtis Ray Droege, Richmond, KY (US); Elios Klemo, Lexington, KY (US); Bryan Dale McKinley, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/765,924

(22) Filed: Apr. 23, 2010

(65) Prior Publication Data

US 2010/0201752 A1 Aug. 12, 2010

Related U.S. Application Data

(62) Division of application No. 11/536,375, filed on Sep. 28, 2006, now Pat. No. 7,784,916.

(51) Int. Cl.
*B41J 2/05* (2006.01)

(52) U.S. Cl. ..... 347/63; 347/56; 347/64

(58) Field of Classification Search ..... 347/17, 347/20, 44, 47, 56, 61–65, 67
See application file for complete search history.

(56) References Cited

U.S. PATENT DOCUMENTS 6,086,187 A * 7/2000 Hattori et al. ..... 347/63
6,637,866 B1 * 10/2003 Cornell et al. ..... 347/64

* cited by examiner

*Primary Examiner* — Juanita D Stephens

(57) ABSTRACT

Methods for fabricating micro-fluid ejection heads and micro-fluid ejection heads are provided herein, such as those that use non-conventional substrates. One such micro-fluid ejection head includes a substrate having first and second glass layers disposed adjacent to a surface thereof and a plurality of fluid ejection actuators disposed adjacent to the second glass layer. The first glass layer is thicker than the second glass layer and the second glass layer has a surface roughness of no greater than about 75 Å Ra.

5 Claims, 4 Drawing Sheets

MICRO-FLUID EJECTION HEADS WITH MULTIPLE GLASS LAYERS

This application claims priority as a divisional application of U.S. Ser. No. 11/536,375, filed Sep. 28, 2006 now U.S. Pat. No. 7,784,916, entitled "Micro-Fluid Ejection Heads with Multiple Glass Layers."

FIELD OF THE DISCLOSURE

The present disclosure is generally directed toward micro-fluid ejection heads. More particularly, in an exemplary embodiment, the disclosure relates to the manufacture of micro-fluid ejection heads utilizing non-conventional substrates and multiple glass layers. This application claims priority as a divisional application of U.S. Ser. No. 11/536,375, filed Sep. 28, 2006.

BACKGROUND AND SUMMARY

Multi-layer circuit devices such as micro-fluid ejection heads have a plurality of electrically conductive layers separated by insulating dielectric layers and applied adjacent to a substrate. Thermal energy generators or heating elements, usually resistors, are located on a surface of the substrate to heat and vaporize the fluid to be ejected.

Conventionally, the substrate material has been silicon, and the heads have been fabricated on typically round single crystalline silicon wafers. Silicon has favorable thermal conductivities such that heat is rapidly dissipated from the heater region. Silicon is also capable of accepting (or being polished to) a smooth finish, which is desirable for predictable and consistent bubble nucleation. However, the use of silicon substrates has proved unsuitable in achieving micro-fluid ejection heads, such as ink jet heads, having a relatively wide swath from a single piece of silicon. For example, silicon wafers used to make silicon chips are available only in round format because the basic manufacturing process is based on a single seed crystal that is rotated in a high temperature crucible to produce a cylindrical ingot that is processed into thin wafers for the semiconductor industry. The circular wafer stock is very efficient when the micro-fluid ejection head chip dimensions are small relative to the diameter of the wafer. However, such circular wafer stock is inherently inefficient for use in making large rectangular silicon chips such as chips having a dimension of 2.5 centimeters or greater. In fact the expected yield of silicon chips having a dimension of greater than 2.5 centimeters from a 6" circular wafer is typically less than about 20 chips. Such a low chip yield per wafer makes the cost per chip prohibitively expensive. In addition, with respect to at least micro-fluid ejector heads, much of the silicon "real estate" has traditionally been used for device (e.g., transistor/logic) fabrication. Conventional fabrication processes and wafers have at least some inherent defect density of defects (e.g., impurity concentrations/lattice defects), any of which might cause a device (e.g., a transistor) to fail, thereby affecting the performance and/or usability of the entire head containing that device. For example, if there are 100 chips on a wafer and 7 such defects, odds are that 6-7 chips will be lost in this fashion, representing a ~7% yield loss. Accordingly, if there are only 10 chips on the wafer and 6-7 are lost, the impact would be much higher (e.g., 60-70%).

Accordingly, there is a need for improved structures and methods for making micro-fluid ejection heads, particularly ejection heads suitable for ejection devices having an ejection swath dimension of greater than about 2.5 centimeters.

In this regard, it has been discovered that substrates for providing micro-fluid ejection heads having a relatively wide swath may be made by utilizing non-conventional substrate materials including, but not limited to, glass, ceramic, metal, and plastic materials. While ceramic materials such as alumina, silicon nitride, and beryllia have adequate thermal conductivity properties, other ceramic and glass materials, such as glass and low temperature co-fired ceramic (LTCC) substrates (which have a significant glass fraction that can be 50% or more) have relatively low thermal conductivities and are unable to effectively dissipate enough heat to prevent overheating of the head, especially if the ejection head is operated at a high frequency. This inability to effectively dissipate heat can undesirably affect performance of the head. For example, fluid, such as ink, entering the thermal ejector region after a fluid ejection phase may boil due to the high temperature in the thermal ejector region. Effective heat dissipation after a fluid ejection phase avoids such conditions.

Another disadvantage of alumina and other ceramic substrates is that it is at best expensive and very technically challenging to achieve the extremely smooth finish which is required for predictable and consistent bubble nucleation. For example, it has been observed that a surface roughness of greater than about 75 Å average roughness (Å Ra) can contribute to unpredictable and inconsistent bubble nucleation and disadvantageously affect fluid ejection.

Exemplary embodiments provided in the present disclosure advantageously provide for the manufacture of ceramic substrates having suitable thermal conductivity and smoothness properties to achieve predictable and consistent fluid bubble so as to be suitable for providing micro-fluid ejection heads.

An advantage of the exemplary heads and methods described herein is that, for example, large array substrates may be fabricated from non-conventional substrate materials including, but not limited to, glass, ceramic, metal, and plastic materials. The term "large array" as used herein means that the substrate is a unitary substrate having a dimension in one direction of greater than about 2.5 centimeters. However, the heads and methods described herein may also be used for conventional size ejection head substrates.

Accordingly, in one aspect, methods are provided for fabricating micro-fluid ejection heads. In one embodiment, such a method involves substantially flattening a surface of a substrate to substantially remove a camber; applying a first glass material adjacent to the substantially flattened surface; applying a second glass layer adjacent to the first glass layer, wherein the second glass layer has a surface roughness of no greater than about 75 Å Ra; and forming thermal fluid ejection actuators adjacent (e.g., on the free surface of) to the second glass layer.

In another embodiment, a method for fabricating micro-fluid ejection heads involves substantially flattening a surface of a substrate to substantially remove a camber; polishing the flattened substrate to provide a surface having a predetermined peak roughness; applying a first glass material adjacent to the polished flattened substrate at a thickness at least as thick as the peak roughness to provide a first glass layer; applying a second glass layer adjacent to the first glass layer, wherein the second glass layer has a surface roughness of no greater than about 75 Å Ra; and forming thermal fluid ejection actuators adjacent to the second glass layer.

Still another embodiment is provided involving a micro-fluid ejection head having a substrate with first and second glass layers disposed adjacent to a surface thereof and a plurality of fluid ejection actuators disposed adjacent to the second glass layer. The first glass layer is thicker than the second glass layer and the second glass layer has a surface roughness of no greater than about 75 Å Ra.

BRIEF DESCRIPTION OF THE DRAWINGS

Further advantages of exemplary embodiments disclosed herein may become apparent by reference to the detailed description of the embodiments when considered in conjunction with the drawings, which are not to scale, wherein like reference characters designate like or similar elements throughout the several drawings as follows.

DETAILED DESCRIPTION OF EXEMPLARY EMBODIMENTS

As described in more detail below, the exemplary embodiments disclosed herein relate to non-conventional substrates for providing micro-fluid ejection heads. Such non-conventional substrates, unlike conventional silicon substrates, may be provided in large format shapes to provide large arrays of fluid ejection actuators on a single substrate. Such large format shapes are particularly suited to providing page wide printers and other large format fluid ejection devices.

Figure 1:
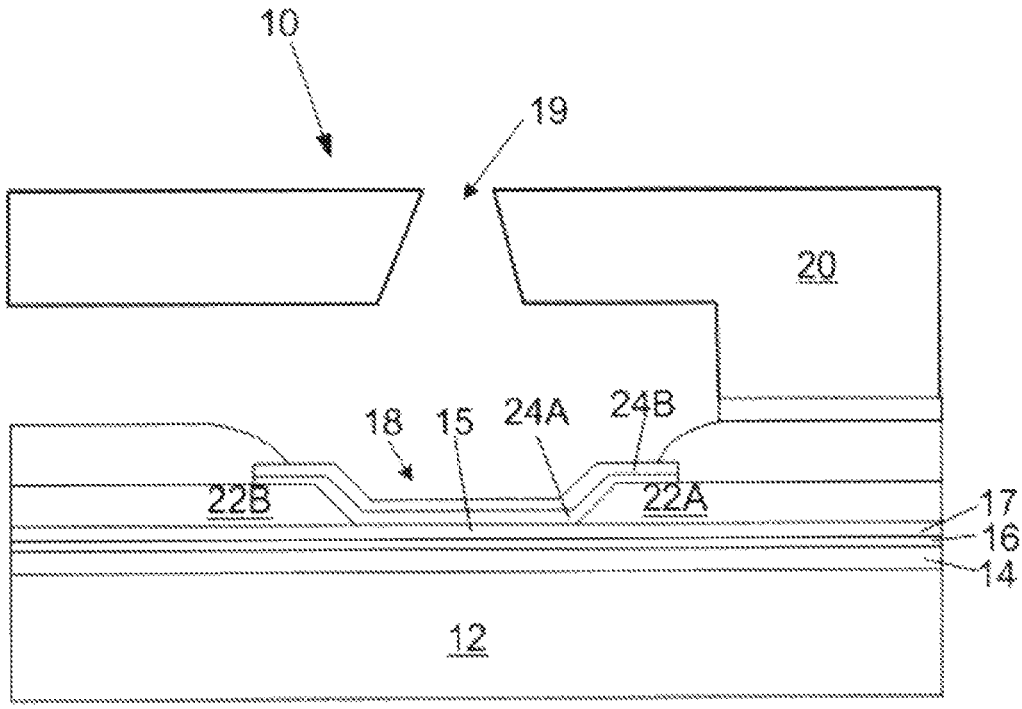
FIG. 1 is a representational cross-sectional view of a micro-fluid ejection head according to an exemplary embodiment.

With reference to FIG. 1, there is shown a plan view of a portion of a micro-fluid ejection head 10, such as an inkjet printhead, having a non-conventional substrate 12 processed to include a first glass layer 14 and a second glass layer 16 according to the disclosure. Such a structure may be used to effectively dissipate heat and provide desirable bubble nucleation characteristics.

In a manner well known in the art, thermal fluid ejection actuators 15, such as heater resistors, are formed from a heater resistor layer 17 adjacent to the second glass layer 16 in an actuator region 18 of the substrate 12. Upon activation of the thermal fluid ejection actuators 15 in the actuator region 18, fluid supplied through fluid paths in an associated fluid reservoir body and corresponding fluid flow slots in the substrate 12 is caused to be ejected toward a media through nozzles 19 in a nozzle plate 20 associated with the substrate 12. Each fluid supply slot may be machined or etched in the substrate 12 by conventional techniques such as deep reactive ion etching, chemical etching, sand blasting, laser drilling, sawing, and the like, to provide fluid flow communication from the fluid source to the device surface of the substrate 12. The plurality of fluid ejection actuators 15 are conventionally provided adjacent to one or both sides of the fluid supply slots.

FIG. 1 shows a portion of the basic micro-fluid ejection head 10 wherein electrically conductive layers separated by insulating dielectric layers are applied adjacent to the substrate 12. The heater resistor layer 17 is deposited adjacent to the second glass layer 16 and an anode layer 22A and a cathode conductor layer 22B may be deposited adjacent to the heater resistor layer 17. The heater resistor layer 17 and the conductor layers 22A and 22B may be patterned and etched using well known semiconductor fabrication techniques to provide a plurality of the fluid ejection actuators 15 on a device surface of the substrate 12. Suitable semiconductor fabrication techniques include, but are not limited to, micro-fluid jet ejection of conductive inks, sputtering, chemical vapor deposition, and the like. Passivation/cavitation layers 24A and 24B are provided over the actuator region 18 in a manner well known in the art. The nozzle plate 20 having the nozzles 19 is located adjacent the actuators 15 in a manner well known in the art.

Figure 4:
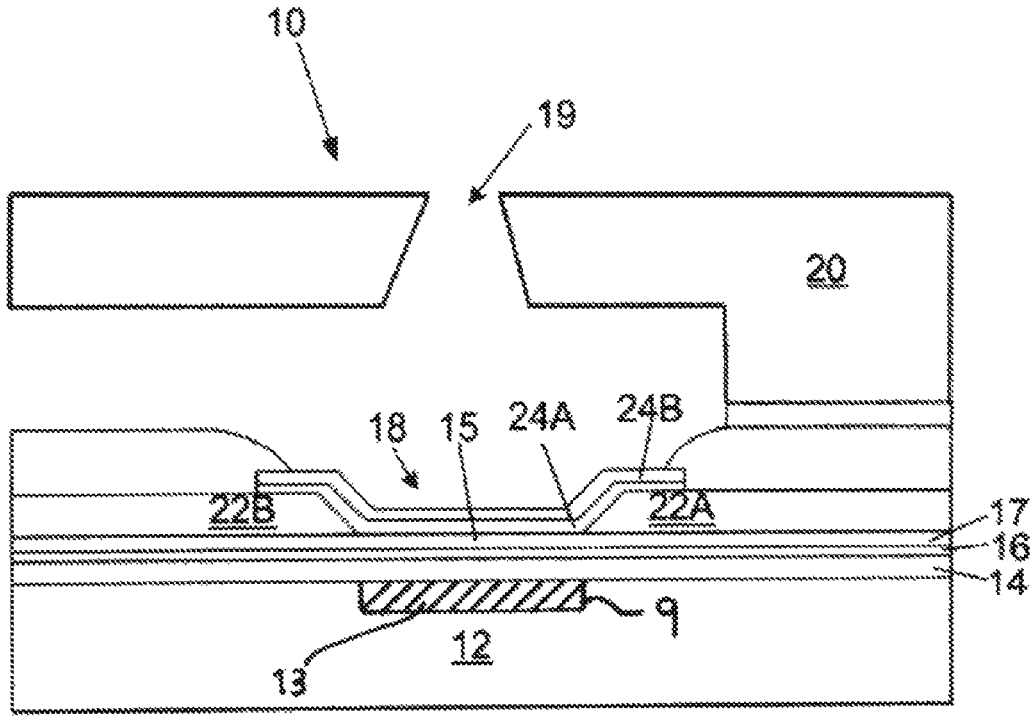
FIG. 4 is a representational cross-sectional view of a micro-fluid ejection head according to FIG. 1, including an exemplary thermal bus trench filled with a thermally conductive material.

The base material used to provide the non-conventional substrate 12 is desirably a low-cost material such as metal, plastic materials, and alumina or other ceramic material, such as low temperature co-fired ceramic (LTCC), or glass. An exemplary relatively low-cost material is 96% alumina. In the case of very low conductivity substrate materials such as glass and LTCC, the substrate 12 may be modified to include a thermal bus provided in FIG. 4 as by a trench 9 filled with a thermally conductive material 13, such as silver, to dissipate heat associated with the operation of the ejection actuators and improve the overall thermal conductivity of the substrate 12 as compared to a corresponding substrate devoid of the thermal bus. The trench may be as wide as the actuator region 18 in the heater resistor layer 17, as shown, but may be shorter or longer in practice. The thus modified substrate may then be processed to include a first glass layer 14 and a second glass layer 16. In an exemplary embodiment, alumina and other substrate materials having a thermal conductivity of at least about 30 W/m-° C. need not be modified to include the thermal bus prior to processing to include the glass layers 14 and 16.

Figure 2:
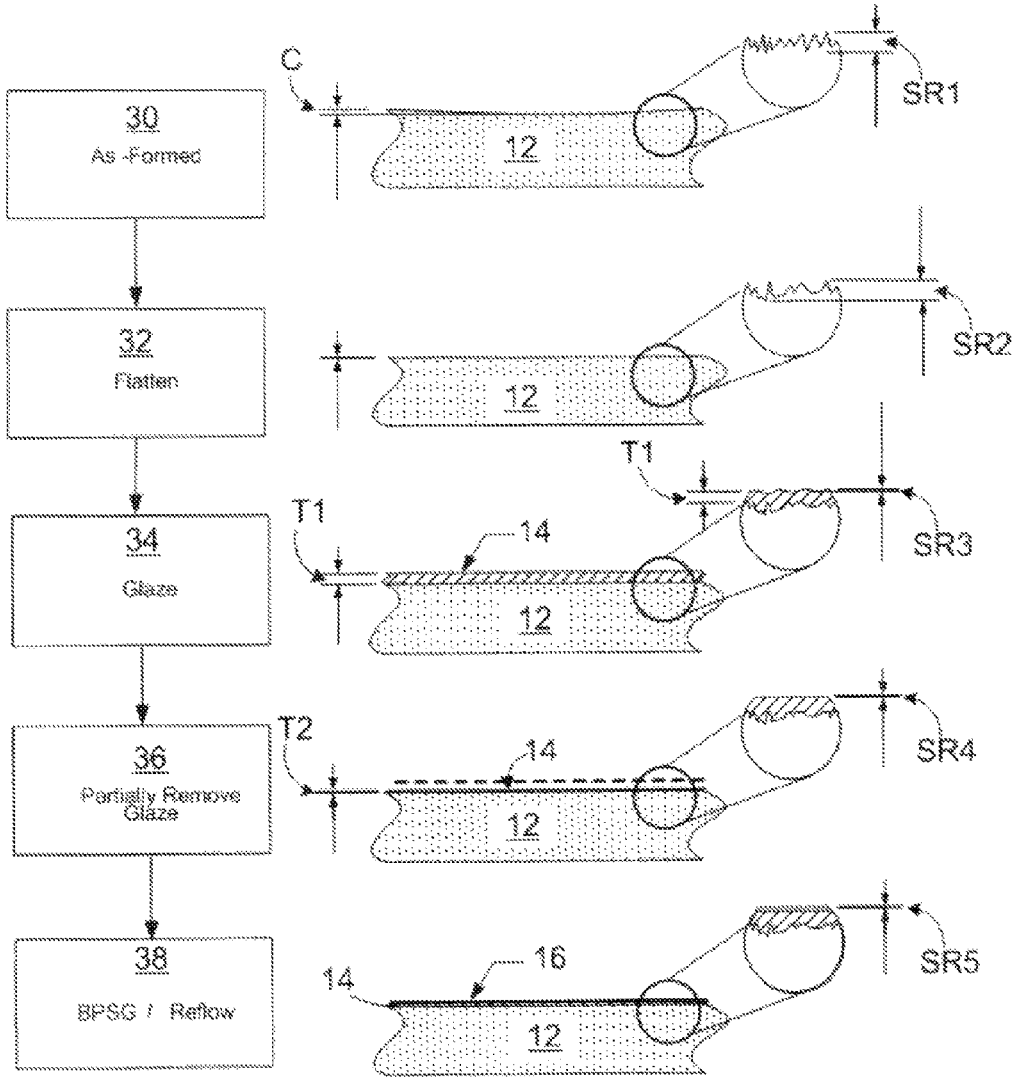
FIG. 2 shows steps in the manufacture of a micro-fluid ejection head according to an exemplary embodiment.
Figure 3:
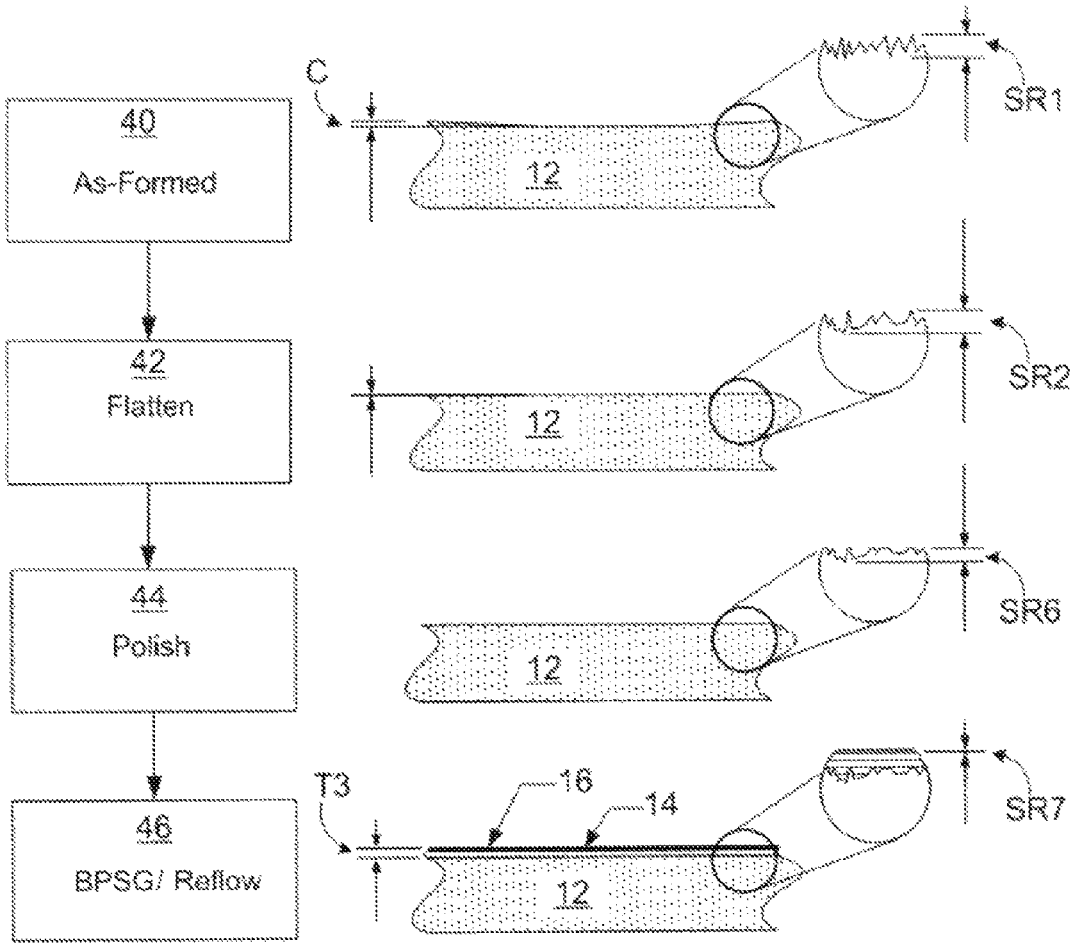
FIG. 3 shows steps in the manufacture of a micro-fluid ejection head according to another exemplary embodiment.

Turning now to FIGS. 2 and 3, there are shown examples of methods for the manufacture of non-conventional substrates processed to include the first glass layer 14 and the second glass layer 16, such as to effectively dissipate heat and provide desirable bubble nucleation characteristics.

With reference to FIG. 2, in a first step 30, the substrate 12 is provided as by a conventional forming/firing process. It has been observed that the substrate 12 yielded, in the case of a 96% alumina material, typically has a surface roughness (SR1) of about 50 μin (1.3 μm) RMS, and a camber (bow) (C) of about 500 μm over a length of about five inches.

In a next step 32, the substrate 12 is substantially flattened. Flattening may be accomplished by, for example, grinding or lapping to substantially remove the camber. This process, if performed at material removal rates that are conducive to low cost manufacturing (high removal rates), may result in grain tear-out on the surface and actually roughen the surface. For example, in the case of 96% alumina, the flattened surface has been observed to be rougher than the pre-flattened roughness (SR2) of about 1.0 to about 3 μm.

In a next step 34, a glaze material may be applied to provide the first glass layer 14. The glaze material may be made up primarily of silicon glass ($SiO_2$) and applied using conventional techniques. The glaze material may be applied at a thickness (T1) of at least about 40 μm to provide a reduced surface roughness (SR3) of no more than about 300 Å Ra. An exemplary glaze material may include a silicon glass glaze available from Kyocera America, Inc. under the trade name GS-5.

In step 36, the thus applied first glass layer 14 may be thinned down to a thickness (T2), such as by standard polishing processes, to render a resulting structure suitable for higher frequency applications. For example, it has been observed that while a thickness (T2) of about 40 μm may be suitable for low firing frequency applications, it may be desirable to thin the first glass layer 14 to a thickness of about 10 μm for higher firing frequency applications. The surface roughness (SR4) after thinning may be about 300 Å Ry.

Meanwhile, in step 38, the second glass layer 16 may be applied (a thermal actuator structure may thereafter be deposited in the manufacture of the micro-fluid ejection head 10). For example, a layer of glass, such as boro-phospho-silicate glass (BPSG), may be applied by chemical vapor depositing (CVD), or spin-on-glass (SOG) or phosphorus doped spin-on-glass (PSOG) may be applied at a thickness of from about 1 to about 3 μm, most desirably, in some cases, from about 1.5 to about 2 μm. If the surface is too rough, e.g., above about 75 Å Ry, the layer may be reflowed, such as at a temperature of about 800° C. (for BPSG), to produce a surface finish within the desired roughness (SR5) (e.g., of no more than about 75 Å Ry).

With reference to FIG. 3, there are shown steps in another method for the manufacture of substrates processed to include the first and second glass layers 14 and 16, such as to effectively dissipate heat and provide desirable bubble nucleation characteristics.

In a first step 40, the substrate 12 is provided as by a conventional forming/firing process. It has been observed that the substrate 12 yielded, in the case of a 96% alumina material, typically has a surface roughness (SR1) of about 50 μin (1.3 μm) RMS, and a camber (bow) (C) of about 500 μm over a length of about five inches.

In a next step 42, the substrate is substantially flattened. Flattening may be accomplished by, for example, grinding or lapping to substantially remove the camber. This process, if performed at material removal rates that are conducive to low cost manufacturing (high removal rates), may result in grain tear-out on the surface and actually roughen the surface. For example, in the case of 96% alumina, the flattened surface has been observed to be rougher than the pre-flattened roughness (SR2) of about 1.0 to about 3 μm. As will be observed, the steps 40 and 42 may correspond to the process steps 30 and 32 previously described in connection with FIG. 2.

In step 44, and deviating from the prior described process, the substrate may be polished to a surface roughness (SR6) of about 0.5 μm Ry, such as by using common polishing methods.

In multi-stage step 46, the first and second glass layers 14 and 16, which may be boro-phospho-silicate glass layers in an exemplary embodiment, are applied. The application process for the layers 14 and 16 may be accomplished by, for example, applying a low-boron BPSG layer at a thickness at least as thick as the peak roughness to provide the first glass layer 14. If desired, a reflow step can occur prior to the application of the second glass layer 16 described below. For low boron content, an exemplary reflow temperature may be about 1000° C.

Next, a high-boron BPSG layer may be applied to a combined thickness (T3) of about 1.0 to about 3.0 μm to provide the second glass layer 16. The second glass layer 16 may be reflowed at an exemplary temperature of about 800° C. (for high boron formulations) to produce a surface finish within the 75 Å Ry specification. An exemplary reflow method might include the rapid thermal pulse method, described in U.S. Pat. No. 6,261,975, incorporated herein by reference in its entirety. In an exemplary embodiment, the purpose of the two step "low boron/high boron" process is to reduce cycle time, as deposition rates are about twice as high for low boron than high. It has been observed that a reflowed surface roughness (SR7) of 75 Å Ry is common for a reflowed BPSG.

Manufacture of non-conventional substrates according to the embodiments disclosed is believed to yield substrates having suitable thermal conductivity and smoothness properties to achieve predictable and consistent fluid bubble so as to be suitable for providing micro-fluid ejection heads. In accordance with further exemplary embodiments, logic elements and passive devices (e.g., heaters/resistors/wiring) may be created on separate substrates that are interconnected/wired/packaged together to provide a micro fluid ejection device, such as an inkjet printhead. Advantageously, this may allow for a more efficient use of expensive semiconductor real estate. For example, passive devices and/or areas which will be etched/grit blasted away (e.g., ink vias) may not be formed on semiconductor substrates. In a further exemplary embodiment, logic functions could be separated into many smaller chips, which may be manufactured more efficiently at higher yields. Meanwhile, the passive devices (e.g., heaters) may be formed on the same monolithic substrate, which may be important for relative positioning and/or co planarity reasons.

It is contemplated, and will be apparent to those skilled in the art from the preceding description and the accompanying drawings that modifications and/or changes may be made in the embodiments disclosed herein. Accordingly, it is expressly intended that the foregoing description and the accompanying drawings are illustrative of exemplary embodiments only, not limiting thereto, and that the true spirit and scope of the present invention(s) be determined by reference to the appended claims.

The invention claimed is:

1. A micro-fluid ejection head, comprising:

a substantially alumina substrate having first and second glass layers disposed adjacent to a surface thereof and a plurality of fluid ejection actuators disposed above and adjacent to the second glass layer, wherein the first glass layer is thicker than the second glass layer and the second glass layer has a surface roughness of no greater than about 75 Å average roughness.

2. The micro-fluid ejection head of claim 1, wherein the fluid ejection actuators comprise resistors.

3. The micro-fluid ejection head of claim 1, wherein the substrate is a unitary substrate having a dimension in one direction of greater than about 2.5 centimeters.

4. The micro-fluid ejection head of claim 1, wherein the first glass layer has a thickness of between about 10 and about 40 μm, and the second glass layer has a thickness of between about 1 and about 3 μm.

5. The micro-fluid ejection head of claim 1, wherein the first and second glass layers are made of boro-phospho-silicate glass.

* * * * *